US005723037A

United States Patent [19]

Herbert et al.

[11] Patent Number: 5,723,037

[45] Date of Patent: Mar. 3, 1998

[54] MAGNETIC FORCE ASSISTED ELECTROFORM SEPARATION METHOD

[75] Inventors: William G. Herbert, Williamson; Loren E. Hendrix, Webster; Gary J. Maier, Webster; Ernest F. Matyi, Webster, all of N.Y.

[73] Assignee: Xerox Corporation, Stamford, Conn.

[21] Appl. No.: 794,109

[22] Filed: Feb. 3, 1997

[51] Int. Cl.[6] ..... C25D 1/20

[52] U.S. Cl. ..... 205/67; 204/DIG. 5; 205/73

[58] Field of Search ..... 205/67–73, 74–79; 204/281, DIG. 5

[56] References Cited

U.S. PATENT DOCUMENTS

| | | | |
|---|---|---|---|
| 3,607,675 | 9/1971 | Haines | 204/10 |
| 3,661,726 | 5/1972 | Denes | 204/10 |
| 4,045,301 | 8/1977 | Wens et al. | 204/12 |
| 4,501,646 | 2/1985 | Herbert | 204/4 |
| 4,781,799 | 11/1988 | Herbert et al. | 204/9 |
| 4,902,386 | 2/1990 | Herbert et al. | 204/9 |
| 5,021,109 | 6/1991 | Petropoulos | 156/137 |
| 5,064,509 | 11/1991 | Melnyk et al. | 204/9 |

*Primary Examiner*—Kathryn L. Gorgos
*Assistant Examiner*—William T. Leader
*Attorney, Agent, or Firm*—Zosan S. Soong

[57] ABSTRACT

There is disclosed a method for separating an electroformed article from a mandrel wherein the article is more attracted to a magnetic force than the mandrel comprising employing the magnetic force on the article in separating the article and the mandrel.

11 Claims, No Drawings

MAGNETIC FORCE ASSISTED ELECTROFORM SEPARATION METHOD

BACKGROUND OF THE INVENTION

This invention relates generally to methods for separating an electroformed article from a mandrel, and more particularly to methods employing a magnetic force to assist in the separation of the article and the electroform. The removed electroformed article may be used for example as a substrate in the fabrication of photoreceptors.

Parting of the electroform from the mandrel typically occurs by hand with the worker gripping the central portion of the electroform during parting. This is disadvantageous since one or more of the following may occur: contamination of the electroform surface such as by dirty or contaminated gloves; marring the finish (matte finish is typically employed to eliminate the plywood phenomenon); scratching or denting the electroform surface; rendering parting more difficult by gripping the electroform which reduces any parting gap between the electroform and the mandrel; and physical damage to the mandrel. There is a need for new separation methods which reduce or eliminate one or more of the above described problems, and this need is met by the present invention.

The following documents may be of interest:

Herbert et al., U.S. Pat. No. 4,902,386, discloses a mandrel having an ellipsoid shaped end;

Herbert, U.S. Pat. No. 4,501,646, discloses an electroforming process which effects a parting gap by heating or cooling;

Petropoulos et al., U.S. Pat. No. 5,021,109, discloses devices and methods to facilitate removal of a tubular sleeve from a mandrel, reference for example, col. 11;

Melnyk et al., U.S. Pat. No. 5,064,509, discloses devices and methods to facilitate removal of an electroformed article from a mandrel, reference cols. 12–13;

Herbert et al., U.S. Pat. No. 4,781,799, discloses an elongated electroforming mandrel, the mandrel comprising at least a first segment having at least one mating end and a second segment having at least one mating end, the mating end of the first segment being adapted to mate with the mating end of the second segment.

SUMMARY OF THE INVENTION

The present invention is accomplished in embodiments by providing a method for separating an electroformed article from a mandrel wherein the article is more attracted to a magnetic force than the mandrel comprising employing the magnetic force on the article in separating the article and the mandrel.

DETAILED DESCRIPTION

The electroformed article (also referred to herein as the electroform) is subjected to a magnetic force during or after the parting gap is established between the electroform and the mandrel, wherein the electroform and the mandrel are parted by one of the following techniques: the mandrel is generally stationary while moving the magnetic force in the direction of separation to pull the article from the mandrel; the separation is accomplished by pulling the mandrel from the article while the magnetic force holds the article generally stationary; or the separation is accomplished by pulling the article and the mandrel in opposite directions where the pulling force on the article is the magnetic force. To control the motion of the mandrel, the mandrel is connected to a rotatable drive shaft driven by a motor. The drive shaft and motor may be supported by suitable support members. The mandrel may be vertically and horizontally movable.

In one embodiment, an electromagnet can be used which is activated while the electroform and the mandrel are immersed in the cold water soak (also referred to herein as "cold soak"). The cold soak is the means of establishing the parting gap in this embodiment (by relying on the coefficient of expansion difference between electroform and the mandrel). Separation of the electroform from the mandrel is achieved by removing the mandrel from the cold soak; the electroform stays attached to the electromagnet which can be used to move the electroform to the next process steps, e.g., a rinse, followed by drying, then cutting to length. A permanent magnet can also be used in place of the electromagnet. Preferably, the parting gap is created before the magnetic force is activated; one can do this with a permanent magnet by keeping it out of range until the parting gap is created.

In another embodiment, the electromagnet or permanent magnet contacts the bottom of the electroform after the composite structure (i.e., the electroform on the mandrel) has been removed from the cold soak. Preferably, the magnet does not interfere with any bleed hole at the bottom of the mandrel and the electroform.

Thus, in the present invention, the magnet, which can be either an electromagnet or a permanent magnet, may physically contact the electroform or be spaced apart from the electroform at a distance ranging for example from about 2 mm to about 0.25 cm. The magnetic force is applied to the bottom of the electroform where the electroform may be thicker and will often be cut off to make the electroform the proper length for use. With preferred electroforms, the bottom area is parabolic and extends up the electroform for at least about one centimeter. The magnetic force ranges in strength from about 10 to about 5,000 gauss, and preferably from about 40 to about 200 gauss. Electromagnets and permanent magnets are available from for example Alnico and Sicence First.

Preferably, the electroform is ferromagnetic having a magnetic permeability (also referred to herein as "mp") for instance of least 1.001, preferably at least about 1.008, more preferably from about 5 to about 1200, and most preferably from about 10 to about 1000. The ferromagnetic material of the electroform preferably is ferromagnetic stainless steel including for example stainless steel 410 (mp 700–1000), stainless steel 416, stainless steel 420, stainless steel 434 (top 600–1100), stainless steel 440A, and ferromagnetic stainless steel 304. Other preferred ferromagnetic materials for the electroform include nickel, iron, and cobalt. Other suitable magnetic materials for the electroform as well as a description of the general principles of magnetism are discussed in F. Brailsford, "Physical Principles of Magnetism" (1966); Richard M. Bozorth, "Ferromagnetism" (1978); and American Society For Metals, "Metals Handbook Ninth Edition, Vol. 3 Properties and Selection: Stainless Steels, Tool Materials and Special-Purpose Metals," pp. 597–611, the disclosures of which are totally incorporated herein by reference. Magnetic permeability refers to a material which extends the magnetic lines of flux versus ferromagnetic which is a material (for example, iron, nickel, cobalt) which is attracted to and/or held to a magnet. Ferromagnetic materials are also magnetically permeable.

Preferably, the mandrel is nonmagnetic having a magnetic permeability ("mp") for example of less than 1.001. Materials for the mandrel include for example chromium plated aluminum (mp $10^{-5}$), nonmagnetic 304 stainless steel (top $10^{-3}$), and chromium plated nonmagnetic 304 stainless steel (mp $10^{-3}$). Other materials for the mandrel are described herein.

The present method minimizes or eliminates one or more of the following: contamination of the electroform surface such as by dirty gloves; marring the finish (matte finish is typically employed to eliminate the plywood phenomenon); scratching or denting the electroform surface; and making parting more difficult by gripping the electroform which reduces any parting gap between the electroform and the mandrel. The present method employing the magnetic force preferably fails to distort the parting gap between the electroform and the mandrel, thereby facilitating their separation; previously, a worker, by manually gripping the electroform, would decrease the parting gap to 0 in certain places and would increase the parting gap in other places, thereby distorting the parting gap and making separation more difficult. In addition, the present invention in embodiments may reduce the possibility of physical damage to the mandrel since contact with the mandrel surface is minimized. After the electroform is stripped off the mandrel, the electroform progresses to the next operational step and the mandrel may be cleaned, inspected, and otherwise prepared for reinsertion into the electroform bath where an additional electroform may be made.

The present invention is a novel and nonobvious advance in the field of mandrel/electroform separation. This is because proportionally more magnetic force is needed to attract a thin foil than a thicker and heavier object. When a material with sufficient magnetic permeability is held by a magnet and is itself not a permanent magnet, the magnetic domains which are otherwise randomly oriented in that material become oriented while it is being held by the magnet, thus becoming a magnet while under the influence of the outside magnetic force. When the outside force is removed, the domains return to their original random orientation. In a foil, fewer of the domains have sufficient room or degrees of freedom to become oriented. Thus, a proportionally larger force is required to attract and hold a foil versus an object with more thickness, assuming the same material is used in the foil and the object. Thus, those of ordinary skill in the photoreceptor art would disfavor the use of magnetic force for electroforms since this is an inefficient method of separation from the viewpoint of force needed per unit of surface area for the kind of electroforms typically employed as photoreceptor substrates.

In embodiments, an optional effective parting gap may be created between a portion of the electroform and the mandrel to facilitate separation. Preferably, the parting gap ranges from about 0.1 mm to about 1 cm, and more preferably from about 0.1 mm to about 5 mm in width separating the electroform and the mandrel. The parting gap may be created by any suitable method including reliance on differences in the coefficients of thermal expansion between the mandrel and the article. Processes to create a parting gap are illustrated in Bailey et al., U.S. Pat. No. 3,844,906 and Herbert, U.S. Pat. No. 4,501,646, the disclosures of which are totally incorporated by reference.

The mandrel may have any effective design, and may be hollow or solid. The mandrel may have any effective cross-sectional shape such as cylindrical, oval, square, rectangular, or triangular. In embodiments, the mandrel has tapered sides. A preferred mandrel has an ellipsoid or parabolic shaped end, with the mandrel profile preferably like that illustrated in Herbert et al. U.S. Pat. No. 4,902,386, the disclosure of which is totally incorporated by reference. Such a mandrel with an ellipsoid or parabolic shaped end is preferred since the resulting electroform will have a corresponding ellipsoid or parabolic shaped end which provides a gripping surface. Any damage to the ellipsoid or parabolic shaped end of the electroform during parting is generally of no consequence since the end may be discarded, such as by cutting off, in the processing of photoreceptor substrates. The top end of the mandrel may be open or closed, flat or of any other suitable design. The mandrel may be of any suitable dimensions. For example, the mandrel may have a length ranging from about 5 cm to about 100 cm; and an outside diameter ranging from about 5 cm to about 30 cm. The mandrel may be fabricated from any suitable low magnetic permeability material, preferably a metal such as aluminum, copper, and the like.

An optional hole or slight depression at the end of the mandrel is desirable to function as a bleeding hole to facilitate more rapid removal of the electroformed article from the mandrel. The bleed hole prevents the deposition of metal at the apex of the tapered end of the mandrel during the electroforming process so that ambient air may enter the space between the mandrel and the electroformed article during removal of the article subsequent to electroforming. The bleed hole should have sufficient depth and circumference to prevent hole blocking deposition of metal during electroforming. For a small diameter mandrel having an outside diameter between about 1/16 inch (0.2 mm) and about 2.5 inches (63.5 mm) a typical dimension for bleed hole depth ranges from about 3 mm to about 14 mm and a typical dimension for circumference ranges from about 5 mm and about 15 mm. Other mandrel diameters such as those greater than about 63.5 mm may also utilize suitable bleed holes having dimensions within and outside these depth and circumference ranges.

The mandrel may be optionally plated with a protective coating. The plated coating is generally continuous except for areas that are masked or to be masked and may be of any suitable material. Typical plated protective coatings for mandrels include chromium, nickel, alloys of nickel, and the like. The plated metal should preferably be harder than the metal used to form the electroform and is of an effective thickness of for example at least 0.006 mm in thickness, and preferably from about 0.008 to about 0.05 mm in thickness. The outer surface of the plated mandrel preferably is passive, i.e., abhesive, relative to the metal that is electrodeposited to prevent adhesion during electroforming. Other factors that may be considered when selecting the metal for plating include cost, nucleation, adhesion, oxide formation and the like. Chromium plating is a preferred material for the outer mandrel surface because it has a naturally occurring oxide and surface resistive to the formation of a strongly adhering bond with the electro-deposited metal such as nickel. However, other suitable metal surfaces could be used for the mandrels. The mandrel may be plated using any suitable electrodeposition process. Processes for plating a mandrel are known and described in the patent literature. For example, a process for applying multiple metal platings to an aluminum mandrel is described in U.S. Pat. Nos. 4,067,782, and 4,902,386, the disclosures of which are totally incorporated by reference.

Articles may be formed on the mandrels of this invention by any suitable known process, preferably electroforming. The electroformed articles may be of any effective thickness, preferably from about 12.5 microns to about 1.25 cm. Electroforms used as a photoreceptor substrate preferably range from about 25 microns to about 250 microns, and especially from about 37 microns to about 125 microns. The electroforming material and the electroformed articles may be of any suitable metal/metal alloy having a magnetic permeability of at least 1.001 including for example nickel, nickel alloys, cobalt, cobalt alloys, iron, and steel.

Processes for electroforming articles on the mandrel are also well known and described, for example, in U.S. Pat. Nos. 4,501,646 and 3,844,906, the disclosures of which are totally incorporated by reference. The electroforming process of this invention may be conducted in any suitable electroforming device. For example, a plated cylindrically shaped mandrel having an ellipsoid shaped end may be suspended vertically in an electrodeposition tank. The electrically conductive mandrel plating material should be compatible with the metal plating solution. For example, the mandrel plating may be chromium. The top edge of the mandrel may be masked off with a suitable non-conductive material, such as wax to prevent deposition. The electrodeposition tank is filled with a plating solution and the temperature of the plating solution is maintained at the desired temperature such as from about 45 to about 65 degrees C. The electrodeposition tank can contain an annular shaped anode basket which surrounds the mandrel and which is fried with metal chips. The anode basket is disposed in axial alignment with the mandrel. The mandrel is connected to a rotatable drive shaft driven by a motor. The drive shaft and motor may be supported by suitable support members. Either the mandrel or the support for the electrodeposition tank may be vertically and horizontally movable to allow the mandrel to be moved into and out of the electrodeposition solution. Electrodeposition current such as from about 25 to about 400 amperes per square foot can be supplied to the electrodeposition tank from a suitable DC source. The positive end of the DC source can be connected to the anode basket and the negative end of the DC source connected to a brush and a brush/split ring arrangement on the drive shaft which supports and drives the mandrel. The electrodeposition current passes from the DC source to the anode basket, to the plating solution, the mandrel, the drive shaft, the split ring, the brush, and back to the DC source. In operation, the mandrel is lowered into the electrodeposition tank and continuously rotated about its vertical axis. As the mandrel rotates, a layer of electroformed metal is deposited on its outer surface. When the layer of deposited metal has reached the desired thickness, the mandrel is removed from the electrodeposition tank.

Any suitable method and apparatus may be optionally employed to assist in the removal of the electroformed article from the mandrel. For example, a mechanical parabolic end parting fixture may be employed to grasp the preferably parabolic shaped end of the electroform. The grasping jaws may have as few as three fingers or may completely contact the electroform circumference like a lathe collet. Alternatively, a vacuum cup may be placed under the preferably parabolic shaped end of the mandrel. A vacuum would be generated by the use of air pressure or vacuum pump. In another approach, the electroform/mandrel composite structure is inserted into an induction coil and by energizing the coil the electroform is heated and consequently enlarges, thereby loosening it from the mandrel. In a different approach, vibrational energy, especially ultrasonic energy, is used to cause the electroform to separate from the mandrel. In one embodiment, an ultrasonic bath is used during or after the parting gap is established to assist in removal of the electroform. It is also possible to use a vibrator which contacts the electroform or the mandrel.

In embodiments, the following optional methods and apparatus also may be used to assist in the removal of the electroform from the mandrel. In a first embodiment, the electroform and mandrel are inserted within an induction coil and the coil energized. The energy transfer causes the electroform to expand at a faster rate than the mandrel. Once the sticking force is overcome between the electroform and the mandrel, the electroform is stripped from the mandrel. In a second embodiment, the electroform and mandrel are inserted within an induction coil, a gripper assembly engages the electroform, and the induction coil is energized or the induction coil is energized and then a gripper assembly engages the electroform. The gripper assembly applies an axial force and, as the electroform expands at a faster rate than the mandrel, the electroform is stripped from the mandrel once the sticking force is overcome between the electroform and the mandrel. In a third embodiment, the electroform and mandrel are inserted within an induction coil, a gripper assembly engages the lo electroform, and the induction coil is energized or the induction coil is energized and then a gripper assembly engages the electroform. The gripper assembly applies a rotational force and, as the electroform expands at a faster rate than the mandrel, the electroform is stripped from the mandrel once the sticking force is overcome between the electroform and the mandrel. In a fourth embodiment, the electroform and mandrel are inserted within an induction coil, a gripper assembly engages the electroform, and the induction coil is energized or the induction coil is energized and then a gripper assembly engages the electroform. The gripper assembly applies an axial and rotational force or a rotational and axial force and, as the electroform expands at a faster rate than the mandrel, the electroform is stripped from the mandrel once the sticking force is overcome between the electroform and mandrel.

Other modifications of the present invention may occur to those skilled in the art based upon a reading of the present disclosure and these modifications are intended to be included within the scope of the present invention.

We claim:

1. A method for separating an electroformed article from a mandrel comprising creating a parting gap between the article and the mandrel and separating the article and the mandrel while magnetically attracting the article to a magnetic force, wherein the magnetic force on the article during the separation of the article and the mandrel fails to distort the parting gap.

2. The method of claim 1, wherein the mandrel is generally stationary while moving the magnetic force in the direction of separation to pull the article from the mandrel.

3. The method of claim 1, wherein the separation is accomplished by pulling the mandrel from the article while the magnetic force holds the article generally stationary.

4. The method of claim 1, wherein the separation is accomplished by pulling the article and the mandrel in opposite directions.

5. The method of claim 1, wherein the magnetic force is generated by a permanent magnet.

6. The method of claim 1, wherein the magnetic force is generated by an electromagnet.

7. The method of claim 1, further comprising creating the parting gap between the article and the mandrel prior to magnetically attracting the article to the magnetic force.

8. The method of claim 1, wherein the magnetic force ranges from about 10 to about 5,000 gauss.

9. The method of claim 1, wherein the article is ferromagnetic and the mandrel is nonmagnetic.

10. The method of claim 1, wherein the article has a magnetic permeability of at least 1.001 and the mandrel has a magnetic permeability of less than 1.001.

11. The method of claim 1, wherein the article has a magnetic permeability ranging from about 5 to about 1200.

* * * * *